US007886710B2

(12) United States Patent
Tomaru

(10) Patent No.: US 7,886,710 B2
(45) Date of Patent: Feb. 15, 2011

(54) OIL FILTER UNIT AND MOTORCYCLE INCLUDING THE OIL FILTER UNIT

(75) Inventor: Yugo Tomaru, Shizuoka-ken (JP)

(73) Assignee: Yamaha Hatsudoki Kabushiki Kaisha, Iwata-Shi (JP)

( * ) Notice: Subject to any disclaimer, the term of this patent is extended or adjusted under 35 U.S.C. 154(b) by 0 days.

(21) Appl. No.: 11/548,217

(22) Filed: Oct. 10, 2006

(65) Prior Publication Data

US 2007/0175433 A1 Aug. 2, 2007

(30) Foreign Application Priority Data

Oct. 13, 2005 (JP) ..... 2005-299083

(51) Int. Cl.
*F01M 1/02* (2006.01)

(52) U.S. Cl. ..... 123/196 R; 123/195 R

(58) Field of Classification Search ..... 123/196 AB, 123/71 R, 41.38, 196 R, 195 R, 195 C, 196 CP; 184/6.5, 1.5, 6.8
See application file for complete search history.

(56) References Cited

U.S. PATENT DOCUMENTS

| | | | | |
|---|---|---|---|---|
| 3,641,987 | A * | 2/1972 | Hooper | 123/71 R |
| 4,174,699 | A | 11/1979 | Gill | |
| 4,576,126 | A * | 3/1986 | Ancheta | 123/41.38 |
| 4,578,126 | A * | 3/1986 | Rezek et al. | 117/67 |
| 5,363,823 | A * | 11/1994 | Gittlein | 123/196 AB |
| 6,863,036 | B2 * | 3/2005 | Kato | 123/73 AD |
| 6,871,627 | B2 * | 3/2005 | Fujikubo | 123/196 R |
| 7,422,021 | B2 * | 9/2008 | Leaphart | 134/22.18 |

FOREIGN PATENT DOCUMENTS

| | | |
|---|---|---|
| DE | 40 40 721 | 7/1991 |
| EP | 0 937 868 A1 | 8/1999 |
| EP | 1 217 181 A1 | 6/2002 |
| JP | 59-020518 | 2/1984 |
| JP | 59-099021 | 6/1984 |
| JP | 60-017220 | 1/1985 |
| JP | 11-148347 | 6/1999 |
| JP | 2001-207818 | 8/2001 |
| JP | 2001-227317 | 8/2001 |
| JP | 2004-204771 | 7/2004 |

* cited by examiner

*Primary Examiner*—Michael Cuff
*Assistant Examiner*—Keith Coleman
(74) *Attorney, Agent, or Firm*—Rabin & Berdo, PC

(57) ABSTRACT

An oil filter unit that forms oil passages regardless of the attachment position of an oil filter. An adaptor for attaching the oil filter to a crank case has a first attachment surface on the crank case side and a second attachment surface on the oil filter side. The first attachment surface has first and second closed areas separated from each other by a partitioning wall. The second attachment surface has oil inlet and outlet ports. The oil inlet and outlet ports communicate with the first and second closed areas, respectively, via their own communication paths. The adaptor is attached to the crank case such that an oil supply port formed on the crank case is positioned within the first closed area and an oil return port formed on the crank case is positioned within the second closed area.

15 Claims, 7 Drawing Sheets

[Fig. 1]
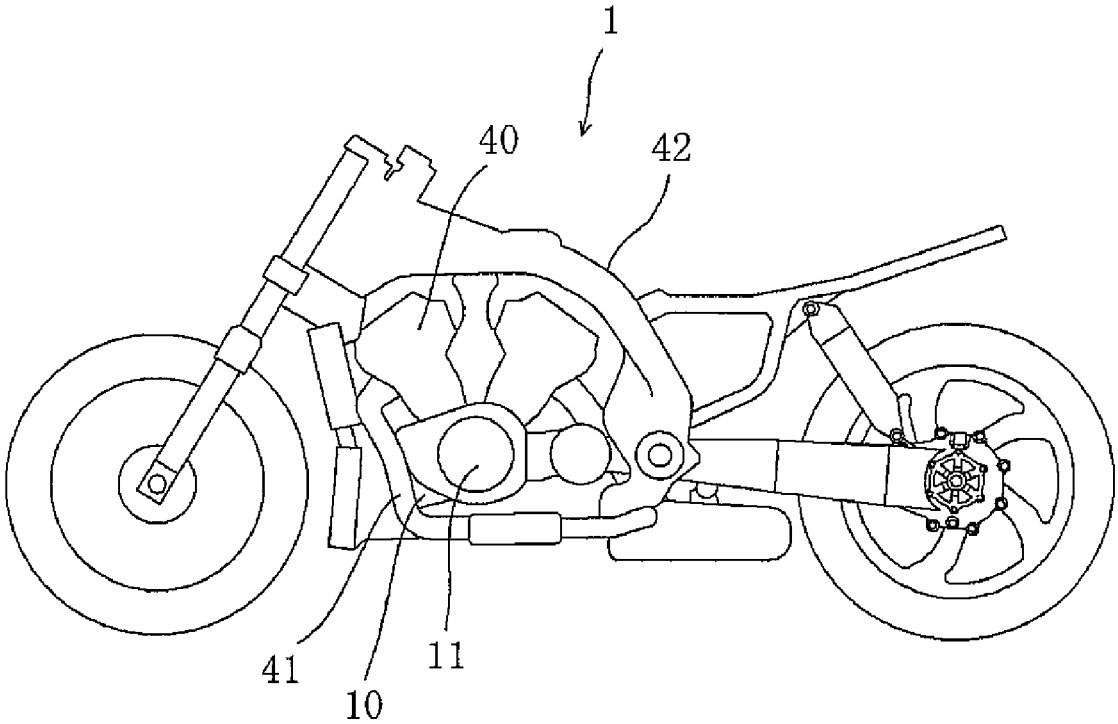

[Fig. 2]
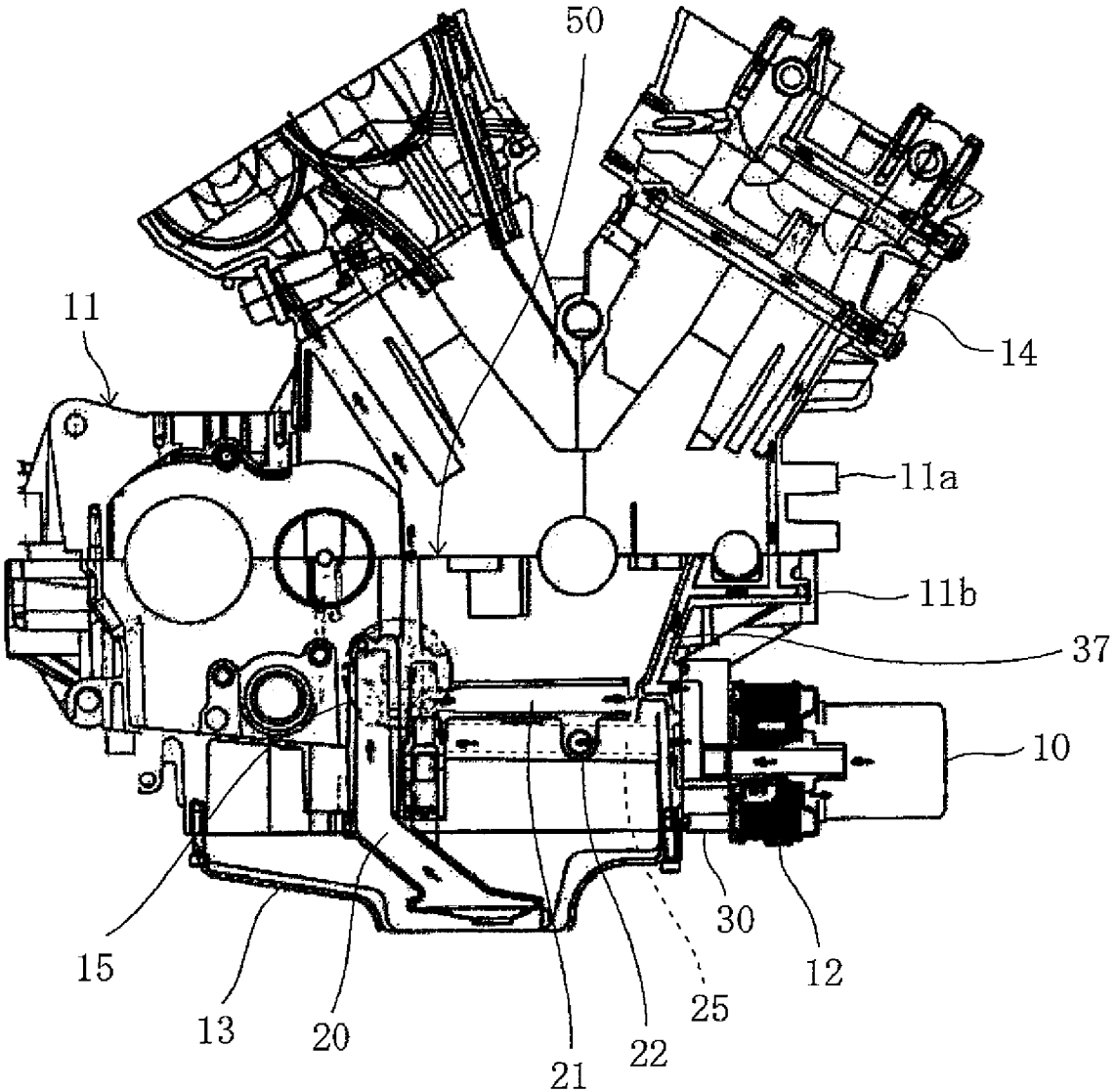

[Fig. 3]
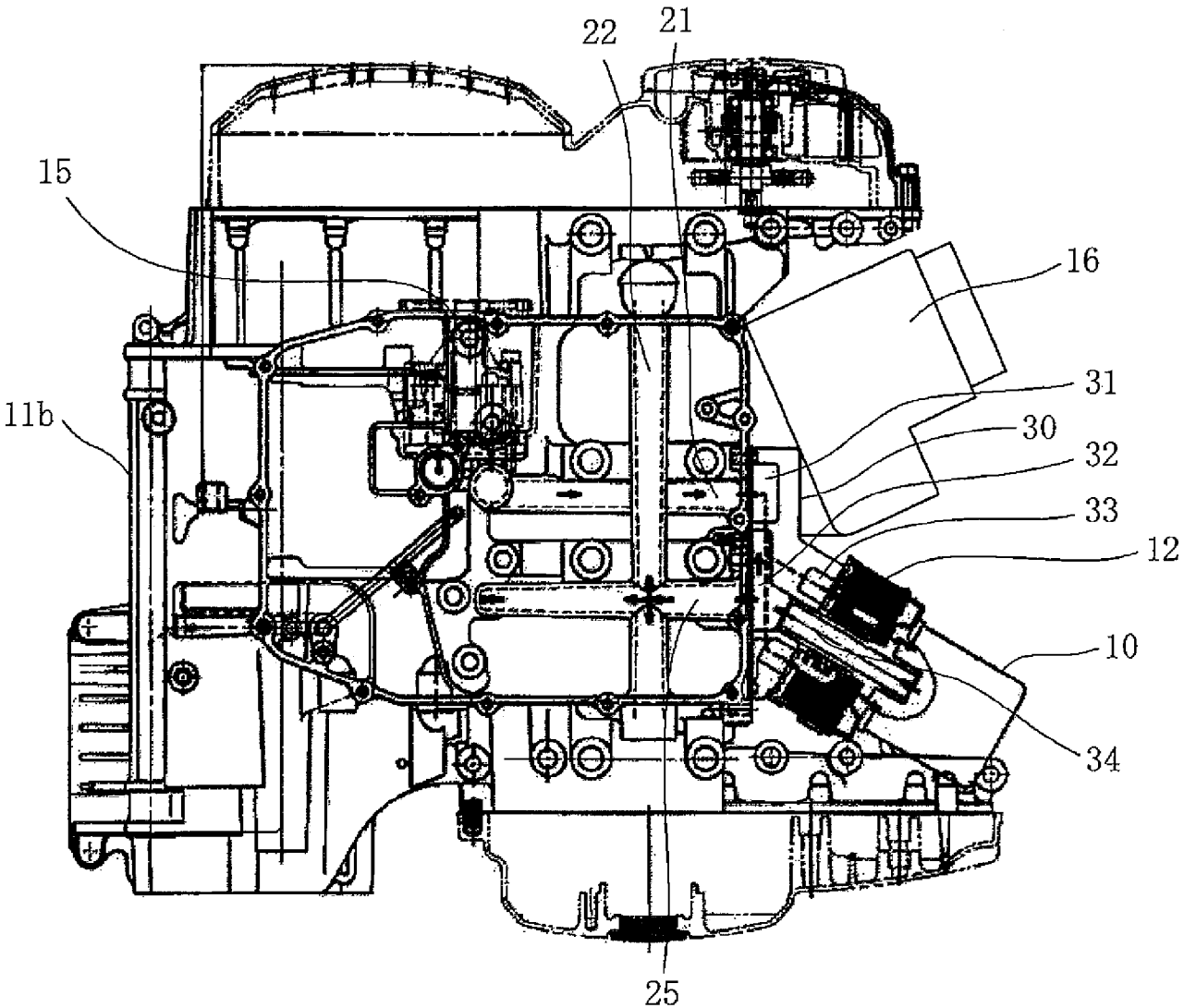

[Fig. 4]
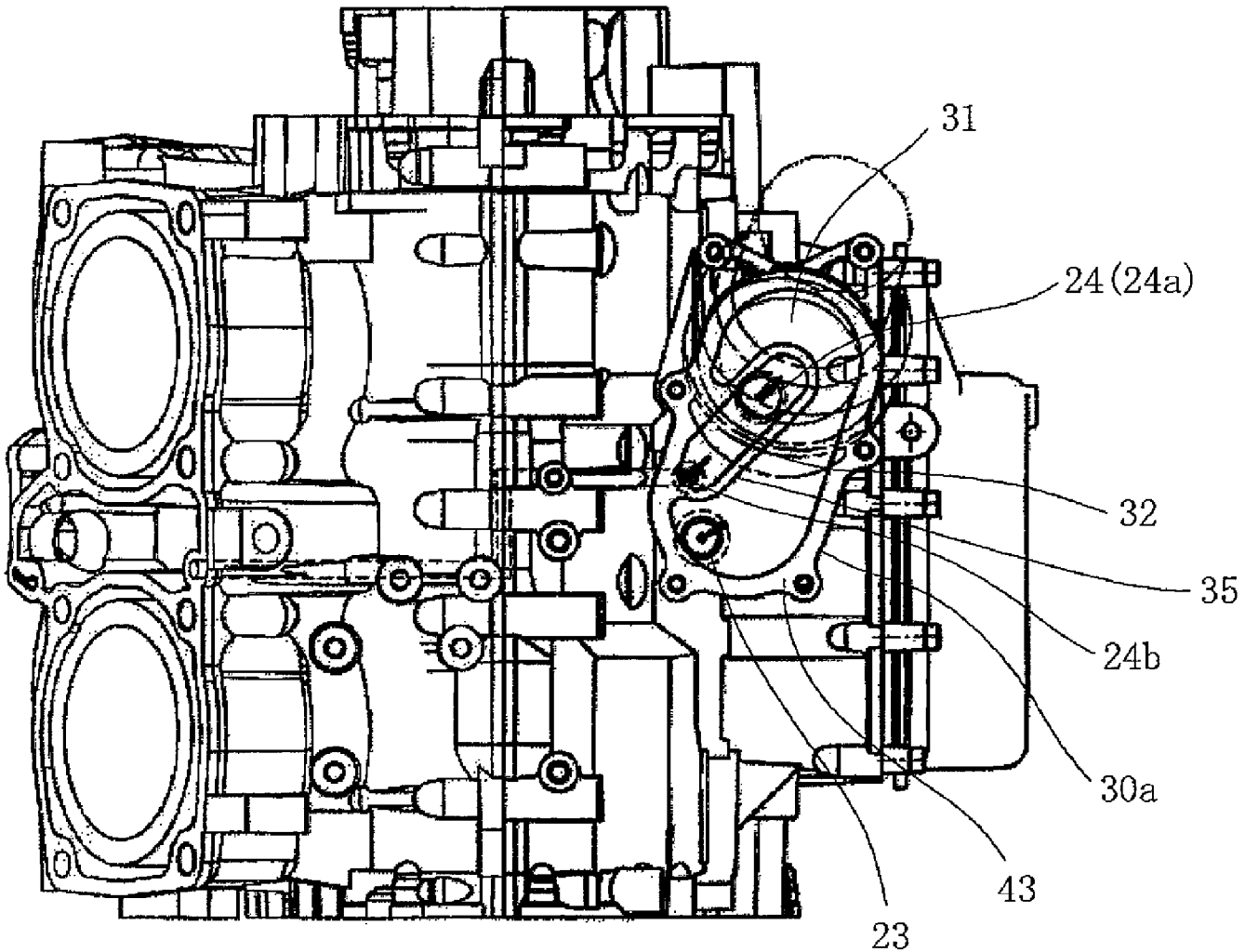

[Fig. 5]
(a)
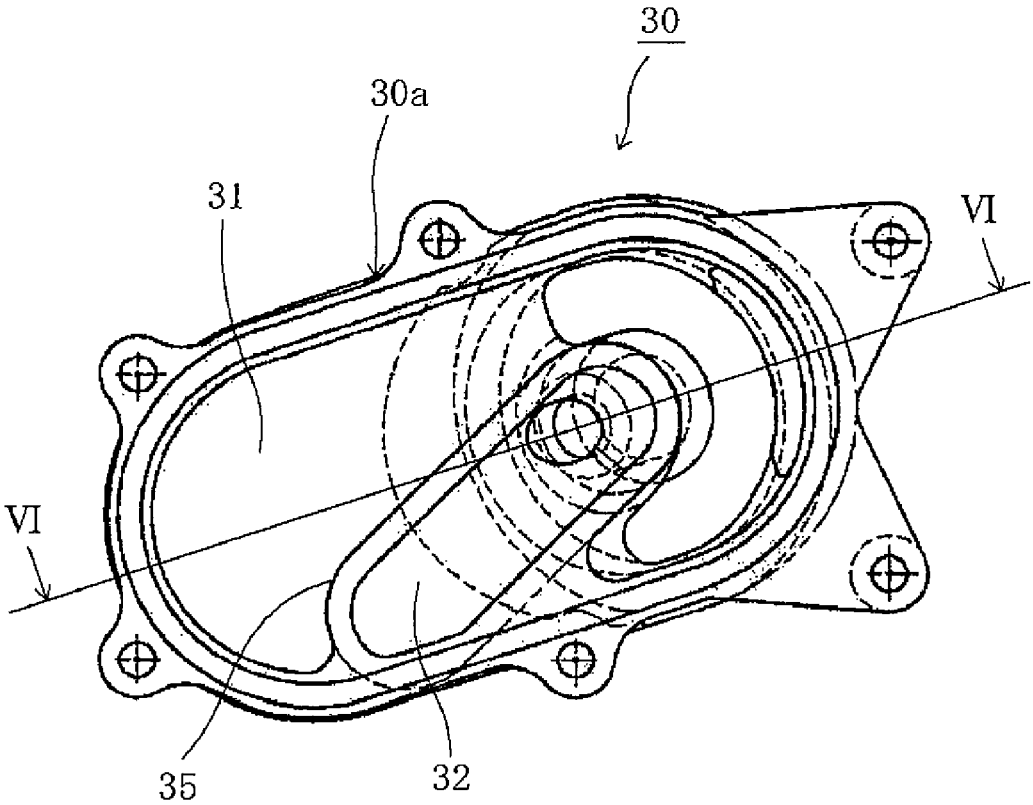
(b)
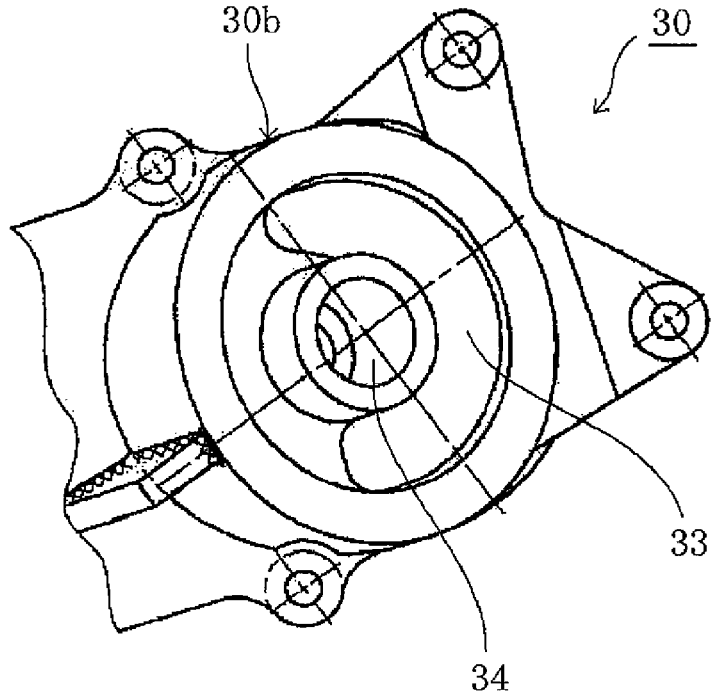

[Fig. 6]
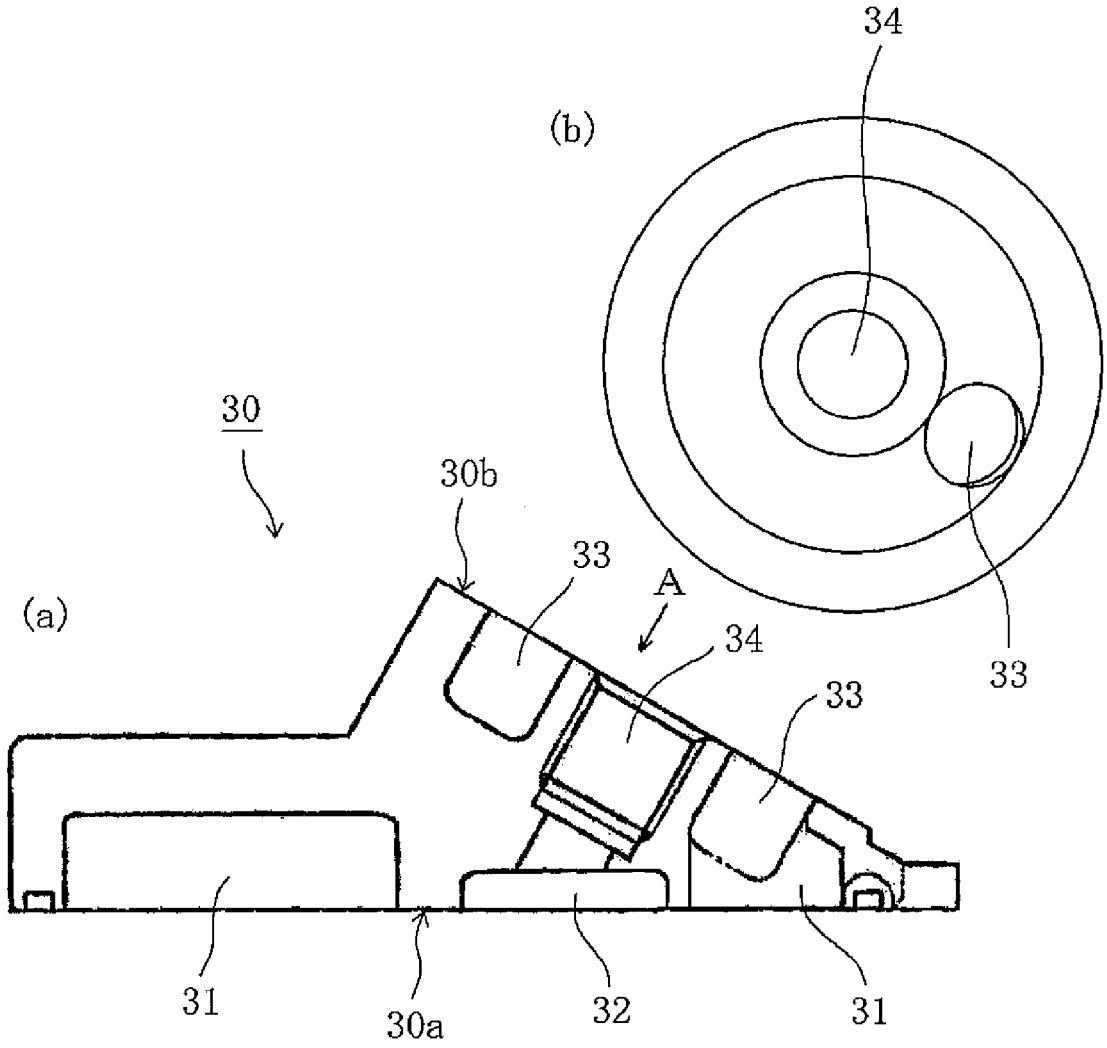

[Fig. 7]
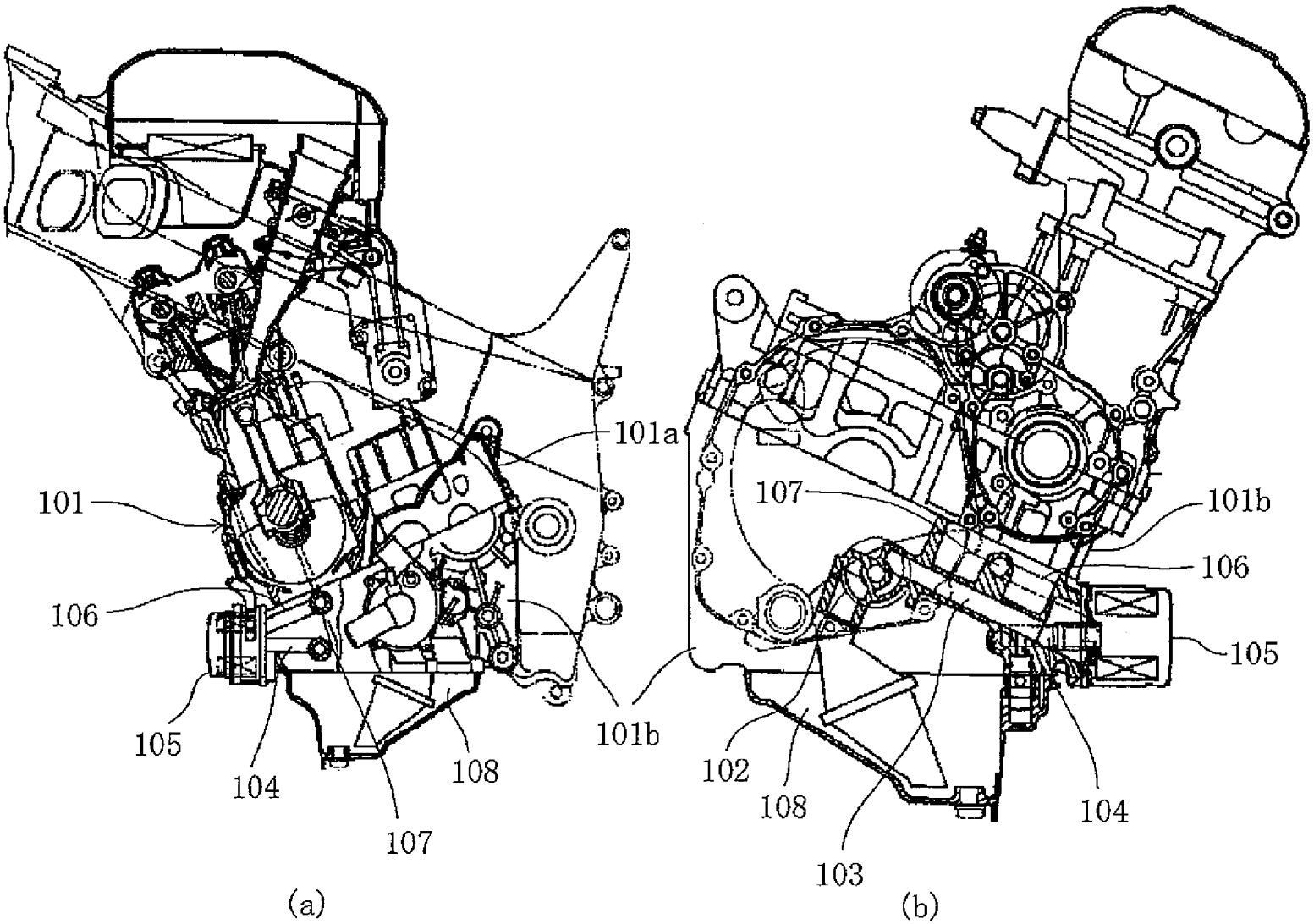

OIL FILTER UNIT AND MOTORCYCLE INCLUDING THE OIL FILTER UNIT

RELATED APPLICATIONS

This application claims the benefit of priority under 35 USC 119 of Japanese patent application no. 2005-299083, filed on Oct. 13, 2005, which application is hereby incorporated by reference in its entirety.

BACKGROUND OF THE INVENTION

1. Field of the Invention

The present invention relates to an oil filter unit and a motorcycle including the oil filter unit.

2. Description of Related Art

A number of metal components such as a cylinder, a piston and a transmission that move at high speed while contacting one another are contained within an engine of a motorcycle. Thus, lubricating oil is supplied to these components using a lubricating device to reduce frictional resistance and obtain sufficient functions from the engine.

Lubricating oil is typically stored in an oil pan disposed below a crank case of an engine, pumped up using an oil pump and filtered by an oil filter. After passing through a main gallery within the crank case, the lubricating oil is supplied with pressure to respective lubrication sections.

Oil passages extending from the oil pump to the main gallery typically cross one another at right angles because of the structure of the crank case. Thus, the attachment face of the oil filter is generally positioned to cross the oil route at right angles (for example, see JP-A-2004-204771).

In some arrangements of the oil pump and attachment positions of the oil filter, however, a number of communication passages are required to form the oil passages. As a result, the number of manufacturing steps necessary for forming the oil passages and communication passages of the crank case increases, and thus the cost rises.

Similar to the oil passages, the communication passages typically cross one another because of the structure of the crank case. It is therefore necessary to dispose the communication passages such that there is no interference between the communication passages and the oil passages. Such an arrangement increases the oil route length and thus lowers the oil pressure in some cases.

A method disclosed in JP-A-2001-227317 simplifies the layout of the oil passages considering these limitations. FIGS. 7(*a*) and 7(*b*) show the structure of the engine case (crank case) of JP-A-2001-227317.

As illustrated in FIGS. 7(*a*) and 7(*b*), an engine case 101 comprises an upper engine case 101*a* and a lower engine case 101*b*. An oil pan 108 is attached to the lower part of lower engine case 101*b*. Lubricating oil within oil pan 108 is pumped up by an oil pump, and is supplied with pressure from an oil delivery passage 103 through a communication path 104 to an oil filter 105. Then, the lubricating oil filtered by the oil filter passes through an oil supply passage 106 and is guided to a main gallery 107. Thereafter, the lubricating oil flows through other oil supply passages (not shown) to be introduced to the respective lubrication sections within the engine.

In this structure, oil delivery passage 103 and oil supply passage 106 are disposed in parallel with the connection plane between upper engine case 101*a* and lower engine case 101*b*, and communication path 104 is disposed in parallel with the connection plane between lower engine case 101*b* and oil pan 108. In this layout, communication passage 104 is not in parallel with oil delivery passage 103 and oil supply passage 106 and thus does not interfere with oil delivery passage 103 and oil supply passage 106. Thus, the distance between communication passage 104 and oil filter 105 can be decreased to a minimum length.

According to this layout of JP-A-2001-227317, the respective oil passages extending from the oil pump to the main gallery cross one another at right angles. However, the communication path extending from the oil (delivery) passage to the oil filter does not cross the oil passages at right angles. Therefore, this structure is effective in that the communication path does not interfere with the oil passages. However, considering the structure of an engine case, it is extremely difficult to manufacture a communication path which does not cross the oil passages at right angles. Therefore, the manufacturing cost of a layout such as that shown in JP-A-2001-227317 is considerable.

SUMMARY OF THE INVENTION

The invention solves these problems and provides an oil filter unit with oil passages formed at low manufacturing cost regardless of the attachment position of the oil filter.

An oil filter unit according to the invention includes an oil filter, and an adaptor for attaching the oil filter to an attachment seating surface of a crank case. The adaptor has a first attachment surface to be attached to the attachment seating surface of the crank case and a second attachment surface to be attached to the oil filter. The first attachment surface has a first closed area and a second closed area separated from each other by a partitioning wall. The second attachment surface has an oil inlet port through which oil is introduced from an oil pump and an oil outlet port through which oil is discharged to an oil passage formed in the crank case. The oil inlet port communicates with the first closed area formed on the first attachment surface and the oil outlet port communicates with the second closed area formed on the first attachment surface. The adaptor is attached to the attachment seating surface of the crank case such that an oil supply port formed on the attachment seating surface of the crank case is positioned within the first closed area and that an oil return port formed on the attachment seating surface of the crank case is positioned within the second closed area.

In one embodiment, the crank case has a first crank case and a second crank case separable from each other, and the adaptor attachment seating surface of the crank case is disposed substantially perpendicular to the connection plane between the first crank case and the second crank case.

In one embodiment, the crank case has a cylinder head, the oil return port has a first oil return port and a second oil return port. The first oil return port communicates with a main gallery provided within the crank case via a first oil passage, and the second return port communicates with the cylinder head via a second oil passage.

In one embodiment, the second attachment surface is inclined with respect to the first attachment surface.

In one embodiment, the main gallery provided within the crank case is disposed parallel to the connection plane between the first crank case and the second crank case, and an oil supply passage communicating with the oil supply port formed on the attachment seating surface of the crank case and an oil return passage communicating with the oil return port formed on the attachment seating surface of the crank case cross the main gallery at right angles.

The invention also comprises an adaptor constructed as described above, as well as a motorcycle including the above oil filter unit and/or adaptor.

In an oil filter unit according to the invention, the route of lubricating oil extending from an oil pump through an oil filter to a main gallery is easily formed by attaching the oil filter to an attachment seating surface of a crank case via an adaptor. A first closed area and a second closed area formed on a first attachment surface (surface to be attached to the attachment seating surface of the crank case) of the adaptor becomes the oil route reaching an oil supply port and an oil return port formed on the attachment seating surface of the crank case.

According to the invention, therefore, the positions of the oil route connection ports (oil supply port and oil return port) formed on the crank case can be separated from the positions of the oil route connection ports (oil inlet port and oil outlet port) formed on the oil filter by providing the desired oil route extending from the oil passage of the crank case to the oil filter within the adaptor in advance.

Accordingly, the oil filter unit according to the invention can securely form the oil passages within the crank case at low manufacturing cost regardless of the attachment position of the oil filter without requiring complicated structure of the oil passages.

Other features and advantages of the invention will be apparent from the following detailed description, taken in conjunction with the accompanying drawings which illustrate, by way of example, various features of embodiments of the invention.

BRIEF DESCRIPTION OF THE DRAWINGS

FIG. 1 is a side view of a motorcycle including an oil filter unit according to the invention.

FIG. 2 is a right side view of the oil filter unit according to the invention.

FIG. 3 is a bottom view of the oil filter unit according to the invention.

FIG. 4 is a front view of the oil filter unit according to the invention.

FIG. 5(*a*) is a plan view of a first attachment surface of an adaptor according to the invention.

FIG. 5(*b*) is a perspective view of a second attachment surface of the adaptor according to the invention.

FIG. 6(*a*) is a cross-sectional view taken along line VI-VI of FIG. 5(*a*).

FIG. 6(*b*) is a plan view as viewed from a direction of arrow A of FIG. 6(*a*).

FIG. 7(*a*) is a left side cross-sectional view of an engine case (crank case) in a related art.

FIG. 7(*b*) is a right side cross-sectional view of the engine case in the related art.

DETAILED DESCRIPTION OF THE INVENTION

An embodiment of the invention is hereinafter described with reference to the appended drawings. For simplifying the explanation, similar reference numerals are given to components having substantially similar functions in the figures. The invention is not limited to the following embodiment.

FIG. 1 illustrates a motorcycle 1 having an oil filter unit according to the invention. A crank case 11 containing an engine 40 is suspended from a vehicle body frame 42. An oil filter 10 is disposed before the crank case 11 in such a position as not to interfere with an exhaust pipe 41 extending from the cylinders of engine 40 toward the rear or other components.

Next, a structure in which the oil filter unit according to the invention is attached to crank case 11 is discussed with reference to FIGS. 2-4. FIG. 2 is a right side view, FIG. 3 is a bottom view, and FIG. 4 is a front view of the oil filter unit.

As illustrated in FIG. 2, crank case 11 comprises a first crank case 11*a* and a second crank case 11*b* separable from each other. An oil pan 13 is attached to the lower part of second crank case 11*b*. An oil filter 10 is attached to the front face of second crank case 11*b*. While oil filter 10 is attached thereto via an oil cooler 12 in this embodiment, oil filter 10 may alternatively be directly attached without interposition of oil cooler 12.

As illustrated in FIGS. 2 and 3, lubricating oil stored in oil pan 13 is pumped up by an oil pump 15 equipped on second crank case 11*b*, and is supplied with pressure to oil filter 10 via an oil pump-up passage 20 and an oil supply passage 21. Then, the lubricating oil filtered by oil filter 10 is sent with pressure to a main gallery 22 via an oil return passage 25, and is supplied with pressure to respective lubrication sections of the engine.

Next, the route of lubricating oil flowing from oil supply passage 21 through oil filter 10 to main gallery 22 is discussed with reference to FIGS. 3 and 4.

As illustrated in FIGS. 3 and 4, oil filter 10 is attached to an attachment seating surface 43 of crank case 11 via an adapter 30. Adapter 30 has a first attachment surface 30*a* attached to attachment seating surface 43 of the crank case, and a second attachment surface (not shown) attached to oil filter 10. First attachment surface 30*a* has a first closed area 31 and a second closed area 32 partitioned from each other by a partitioning wall 35. The second attachment surface has an oil inlet port 33 through which oil is introduced to oil filter 10, and an oil outlet port 34 through which oil is discharged to crank case 11.

Oil inlet port 33 communicates with first closed area 31 via a communication path (not shown) formed within adapter 30. Oil outlet port 34 communicates with second closed area 32 via a communication path (not shown) formed within adapter 30.

As illustrated in FIG. 4, an oil supply port 23 provided on attachment seating surface 43 of crank case 11 is positioned within the first closed area 31 of the adapter 30. An oil return port 24 provided on attachment seating surface 43 of the crank case is positioned within second closed area 32 of adapter 30.

In the oil filter unit having the above structure, the route of lubricating oil extending from oil pump 15 through oil filter 10 to main gallery 22 can be easily formed by using first closed area 31 and second closed area 32 provided on first attachment surface 30*a* of adapter 30 as the oil route reaching oil supply port 23 and oil return port 24 formed on attachment seating surface 43 of crank case 11.

More specifically, the positions of the oil route connection ports (oil supply port 23 and oil return port 24) formed on crank case 11 can be separated from the positions of the oil route connection ports (oil inlet port 33 and oil outlet port 34) formed on oil filter 10 by providing the desired oil route extending from the oil passage of crank case 11 to oil filter 10 within adaptor 30 in advance.

Attachment seating surface 43 of crank case 11 is disposed substantially perpendicular to a connection plane 50 between the separable first and second crank cases 11*a* and 11*b*. Thus, main gallery 22 within crank case 11 is disposed in parallel with connection plane 50 between first and second crank cases 11*a* and 11*b*, and oil supply passage 21 communicating with oil supply port 23 formed on attachment seating surface 43 of crank case 11 and oil return passage 25 communicating with oil return port 24 formed on attachment seating surface 43 of crank case 11 cross main gallery 22 at right angles.

Therefore, the oil filter unit can be attached while maintaining the structure where the respective oil passages within crank case 11 cross one another at right angles. Since complicated structures are not required for the oil passages, the processing for forming the oil passages and attachment seating surface 43 of crank case 11 can be easily performed. Thus, an oil filter unit capable of securely forming oil passages at low manufacturing cost regardless of the attachment position of the oil filter is provided.

Next, the structure of adaptor 30 equipped on the oil filter unit according to the invention is discussed with reference to FIGS. 5(*a*), 5(*b*), 6(*a*), and 6(*b*).

As illustrated in FIG. 5(*a*), first attachment surface 30*a* (the surface to be attached to attachment seating surface 43 of crank case 11) has first closed area 31 and second closed area 32 separated from each other by partitioning wall 35. As described above, when adaptor 30 is attached to attachment seating surface 43 of crank case 11, oil supply port 23 formed on attachment seating surface 43 is positioned within first closed area 31 and oil return port 24 formed on attachment seating surface 43 is positioned within second closed area 32.

As illustrated in FIG. 5(*a*), the areas of first closed area 31 and second closed area 32 are larger than the areas of oil supply port 23 and oil return port 24. Thus, oil supply port 23 and oil return port 24 can be disposed at the predetermined positions of crank case 11 with sufficient margins.

As illustrated in FIG. 5(*b*), second attachment surface 30*b* (the surface to be attached to oil filter 10) has oil inlet port 33 through which oil is introduced to oil filter 10 and oil outlet port 34 through which oil is discharged to crank case 11.

As illustrated in FIGS. 6(*a*) and 6(*b*), oil inlet port 33 communicates with first closed area 31 via the communication path formed within adaptor 30, and oil outlet port 34 communicates with second closed area 32 via the communication path formed within adaptor 30.

In this embodiment, second attachment surface 30*b* is inclined with respect to first attachment surface 30*a*. This structure allows oil filter 10 to be attached with inclination to attachment seating surface 43 of crank case 11. Therefore, oil filter 10 can be attached to crank case 11 while avoiding interference with a hydraulic unit 16 attached to the front surface of crank case 11, a radiator (not shown) and exhaust pipe 41 disposed before the front surface of crank case 11, and other components.

The invention is not limited to the embodiment described and depicted herein, and various changes and modifications may be given to the invention. According to this embodiment, adaptor 30 is attached to attachment seating surface 43 of crank case 11 such that oil return port 24 (first oil return port 24*a*) communicating with main gallery 22 via oil return passage (first oil passage) 25 is located within second closed area 32. However, adaptor 30 may be attached to attachment seating surface 43 such that an additional oil return port (second oil return port 24*b*) communicating with a cylinder head 14 within crank case 11 via a second oil passage 37 is located within second closed area 32 (see FIGS. 2 and 4). In this case, the oil passage extending from oil filter 10 to main gallery 22 and cylinder head 14 can be easily formed.

A motorcycle as discussed herein refers to a vehicle which can turn to other directions while inclining its body, such as motorbike and motor scooter. Thus, three-wheel vehicles, four-wheel vehicles and vehicles having more wheels which have two or more wheels for at least either the front wheel or the rear wheel and are classified based on the number of wheels are all considered to be a motorcycle as discussed and claimed herein.

An oil filter unit according to the invention securely forms oil passages at low manufacturing cost regardless of the attachment position of an oil filter.

The particular embodiments of the invention described in this document should be considered illustrative, rather than restrictive. Modification to the described embodiments may be made without departing from the spirit of the invention as defined by the following claims.

The invention claimed is:

1. An oil filter unit, comprising:

an oil filter;

an oil cooler; and an adaptor for attaching the oil filter and the oil cooler to an attachment seating surface of a crank case having a cylinder head, wherein:

the adaptor is more proximate to the crank case than the oil filter and the oil cooler;

the adaptor has a first attachment surface to be attached to the attachment seating surface of the crank case and a second attachment surface to be attached to the oil cooler or the oil filter;

the first attachment surface has a first closed area and a second closed area separated by a partitioning wall;

the second attachment surface has an oil inlet port through which oil is introduced from an oil pump and an oil outlet port through which oil is discharged to an oil passage formed in the crank case;

the oil inlet port communicates with the first closed area formed on the first attachment surface and the oil outlet port communicates with the second closed area formed on the first attachment surface;

the adaptor is attached at the first attachment surface to the attachment seating surface of the crank case such that an oil supply port formed on the attachment seating surface of the crank case is positioned within the first closed area and an oil return port formed on the attachment seating surface of the crank case is positioned within the second closed area;

the oil return port has a first oil return port and a second oil return port;

the first oil return port communicates with a main gallery provided within the crank case via a first oil passage;

the second oil return port communicates with the cylinder head via a second oil passage; and areas of the first closed area and the second closed area are larger, respectively, than areas of the oil supply port and the oil return port.

2. An oil filter unit according to claim 1, wherein:

the crank case has a first crank case and a second crank case separable from each other; and the attachment seating surface of the crank case is disposed substantially perpendicular to a connection plane between the first crank case and the second crank case.

3. An oil filter unit according to claim 1, wherein the second attachment surface is inclined with respect to the first attachment surface.

4. An oil filter unit according to claim 2, wherein:

the main gallery provided within the crank case is disposed parallel to the connection plane between the first crank case and the second crank case; and an oil supply passage communicating with the oil supply port formed on the attachment seating surface of the crank case and an oil return passage communicating with the oil return port formed on the attachment seating surface of the crank case cross the main gallery at right angles.

5. A motorcycle including the oil filter unit of claim 2.

6. A motorcycle including the oil filter unit of claim 1.

7. A motorcycle including the oil filter unit of claim 3.

8. A motorcycle including the oil filter unit of claim 4.

9. The oil filter unit of claim 1, wherein the first closed area has an elongated shape such that, when the oil filter unit is attached at the first attachment surface to the attachment seating surface of the crank case, the oil supply port is positioned substantially at an end of the first closed area and the oil inlet port is positioned substantially at an opposite end of the first closed area.

10. The oil filter unit of claim 1, the adaptor having a stepped portion in which at least a portion of the first closed area is formed.

11. The oil filter unit of claim 1, wherein the first closed area is substantially elliptical in shape.

12. A motorcycle comprising an adaptor for attaching an oil filter and an oil cooler to an attachment seating surface of a crank case, the adaptor comprising:

a first attachment surface to be attached to the attachment seating surface of the crank case having a cylinder head and having a first closed area and a second closed area separated by a partitioning wall;

a second attachment surface to be attached to the oil cooler or the oil filter having an oil inlet port through which oil is introduced from an oil pump and an oil outlet port through which oil is discharged to an oil passage formed in the crank case, the oil inlet port communicating with the first closed area and the oil outlet port communicating with the second closed area; and the adaptor is configured such that, when attached to the attachment seating surface of the crank case, an oil supply port formed on the attachment seating surface of the crank case is positioned within the first closed area and an oil return port formed on the attachment seating surface of the crank case is positioned within the second closed area, wherein the adaptor is more proximate to the crank case than the oil filter and the oil cooler;

the oil return port has a first oil return port and a second oil return port;

the first oil return port communicates with a main gallery provided within the crank case via a first oil passage;

the second oil return port communicates with the cylinder head via a second oil passage; and areas of the first closed area and the second closed area are larger, respectively., than areas of the oil supply port and the oil return port.

13. A motorcycle according to claim 12, wherein the second attachment surface is inclined with respect to the first attachment surface.

14. A motorcycle comprising:

an oil filter unit comprising:

an oil filter;

an oil cooler; and an adaptor for attaching the oil filter and the oil cooler to an attachment seating surface of a crank case having a cylinder head; and an engine comprising the crank case, wherein the oil filter unit is positioned before the crank case, wherein the adaptor is more proximate to the crank case than the oil filter and the oil cooler;

the adaptor has a first attachment surface to be attached to the attachment seating surface of the crank case and a second attachment surface to be attached to the oil cooler or the oil filter;

the first attachment surface has a first closed area and a second closed area separated by a partitioning wall;

the second attachment surface has an oil inlet port through which oil is introduced from an oil pump and an oil outlet port through which oil is discharged to an oil passage formed in the crank case;

the oil inlet port communicates with the first closed area formed on the first attachment surface and the oil outlet port communicates with the second closed area formed on the first attachment surface;

the adaptor is attached at the first attachment surface to the attachment seating surface of the crank case such that an oil supply port formed on the attachment seating surface of the crank case is positioned within the first closed area and an oil return port formed on the attachment seating surface of the crank case is positioned within the second closed area;

the oil return port has a first oil return port and a second oil return port;

the first oil return port communicates with a main gallery provided within the crank case via a first oil passage;

the second oil return port communicates with the cylinder head via a second oil passage; and areas of the first closed area and the second closed area are larger, respectively, than areas of the oil supply port and the oil return port.

15. A motorcycle as claimed in claim 12, and further comprising:

an engine comprising the crank case, wherein the adaptor is positioned before the crank case.

* * * * *